US011891862B2

(12) United States Patent
Yang et al.

(10) Patent No.: US 11,891,862 B2
(45) Date of Patent: Feb. 6, 2024

(54) ELECTROMAGNETIC CLEARANCE JOINT AND ASSEMBLY METHOD THEREOF

(71) Applicant: WEIZHUO PETROTECH (BEIJING) LTD, Beijing (CN)

(72) Inventors: Shaoguo Yang, Beijing (CN); Hangyun Li, Beijing (CN)

(73) Assignee: WEIZHUO PETROTECH (BEIJING) LTD

( * ) Notice: Subject to any disclaimer, the term of this patent is extended or adjusted under 35 U.S.C. 154(b) by 102 days.

(21) Appl. No.: 17/546,912

(22) Filed: Dec. 9, 2021

(65) Prior Publication Data

US 2022/0333446 A1 Oct. 20, 2022

(30) Foreign Application Priority Data

Apr. 15, 2021 (CN) ..... 202110407913.5

(51) Int. Cl.
*E21B 17/02* (2006.01)
*E21B 17/042* (2006.01)

(52) U.S. Cl.
CPC ..... *E21B 17/028* (2013.01); *E21B 17/042* (2013.01)

(58) Field of Classification Search
CPC ..... F16L 25/021; F16L 25/02; F16L 25/025; E21B 17/028; E21B 17/042
See application file for complete search history.

(56) References Cited

U.S. PATENT DOCUMENTS 1,040,971 A * 10/1912 Wirt ..... F16L 25/026 285/286.1
3,822,902 A * 7/1974 Maurer ..... E21B 17/042 285/94
4,496,174 A * 1/1985 McDonald ..... F16L 15/001 285/55
6,916,248 B1 * 7/2005 Burgess ..... E21B 17/02 285/291.1
7,387,167 B2 * 6/2008 Fraser ..... E21B 17/028 166/65.1
10,822,884 B1 * 11/2020 Bargach ..... E21B 17/028
2008/0191900 A1 * 8/2008 Camwell ..... E21B 17/028 340/854.3
2012/0085583 A1 * 4/2012 Logan ..... E21B 17/042 175/50
2017/0044842 A1 * 2/2017 Derkacz ..... E21B 17/042

* cited by examiner

*Primary Examiner* — David Bochna
(74) *Attorney, Agent, or Firm* — C. Tumey Law Group PLLC

(57) ABSTRACT

An electromagnetic clearance joint and an assembly method thereof are provided, the joint includes a mandrel and a shell. An inner diameter of the shell is larger than an outer diameter of the mandrel, the mandrel includes a first structure part and a second structure part which are connected to each other, and the shell includes a third structure part and a fourth structure part which are connected to each other. A plurality of acting grooves are evenly and circumferentially distributed around the first structure part. An outer diameter of the first structure part is gradually reduced, a plurality of annular ridges are sequentially distributed axially on the outer surface of the second structure part and form the ridge structures, a plurality of grooves axially extending are arrayed circumferentially on the outer surface of the second ridge structure.

9 Claims, 9 Drawing Sheets

I - I

ELECTROMAGNETIC CLEARANCE JOINT AND ASSEMBLY METHOD THEREOF

CROSS REFERENCE TO RELATED APPLICATION

This patent application claims the benefit and priority of Chinese Patent Application No. 202110407913.5 filed on Apr. 15, 2021, the disclosure of which is incorporated by reference herein in its entirety as part of the present application.

TECHNICAL FIELD

The present disclosure belongs to the field of drilling technology, and specifically relates to an electromagnetic clearance joint and an assembly method thereof.

BACKGROUND ART

In the prior art, oil and gas drilling or public facilities river-crossing drilling typically utilizes underground sensors to return information to the surface. Generally, these sensors are located at a small distance behind the drill bit and can measure geological parameters, attitude information and/or drilling environment conditions, which are used for evaluating the formation, controlling the wellbore path and monitoring the drilling environment for optimal drilling performance.

In the prior art, there are many different ways of telemetries to transmit sensor information from the downhole to the surface in real time. One of these is electromagnetic telemetry (or EM telemetry), which uses a drill string as an antenna to transmit an alternating electrical signal of relatively low frequency (about 10 Hz) through formation up to the surface, and the electrical signal can be detected by a sensitive receiver on the surface. In order to produce the antenna, the drill string is electrically isolated at some point with a clearance joint known in the art, which generates an electrically isolated clearance along the original conductive steel of the drill string.

A telemetry probe is usually located within the drill string adjacent to the clearance joint, and comprises a power, a sensor and an electronic equipment for driving telemetry. The telemetry probe has an electrical connection to the both side of the clearance joint and transmission is achieved by applying an alternating current to these connections. Then, the current preferentially flows through a low-resistance formation, rather than a high-resistance spacer. Sensitive receivers and advanced filtering techniques are deployed to measure the volts difference between two points on the ground once the current flow through the formation and reach the surface.

In order to withstand the harsh drilling conditions, the telemetry probe is made of a high-strength metal which is inherently conductive. To avoid being part of conductive path, the telemetry probe itself includes an electrically insulating clearance, known in the art as a clearance joint. In the prior art, the clearance joint is usually formed from overlapping spiral thread and requires complex and elaborate processes to assemble the two joint ends so as to accurately and symmetrically form the insulating clearance. However, a threaded joint is prone to human errors in the assembling process, sometimes results in unqualified products which are likely to be reworked or scrapped.

SUMMARY

In order to solve the problems in the prior art, namely to solve the problem of unqualified product caused by human errors in the assembly process of a clearance joint, on the first aspect, the present disclosure provides an electromagnetic clearance joint. The electromagnetic clearance joint comprises a mandrel and a shell, an inner diameter of the shell is larger than an outer diameter of the mandrel. The mandrel includes a first structure part and a second structure part which are sequentially connected, and the shell includes a third structure part and a fourth structure part which are sequentially connected.

A plurality of acting grooves with helical threads on inner wall are evenly and circumferentially distributed around the first structure part.

An outer diameter of the first structure part is gradually reduced in the direction towards the second structure part, a plurality of annular ridges are sequentially distributed axially on the outer surface of the second structure part and form the ridge structures, a plurality of grooves axially extending are arrayed circumferentially on the outer surface of the second ridge structure.

The mandrel is matched with the shell. During assembling, the first structure part is in clearance fit with the third structure part, and the second structure part is in clearance fit with the fourth structure part.

During assembling, the plurality of grooves of the mandrel are aligned with the ridge structures of the shell so that the mandrel can be inserted into the shell. The mandrel is screwed so that the acting grooves of the mandrel are matched with the acting grooves of the shell to form positioning threaded holes, meanwhile the grooves of the mandrel are aligned with the grooves of the shell to form assembly spaces, and the ridge structures of the mandrel are matched with the ridge structures of the shell to form a corrugated pipe-shaped space.

The positioning threaded holes are used for screwing the first insulation limiting structures made of a non-conductive material to primarily limit the mandrel and the shell, the assembly spaces are used for inserting the second insulation limiting structures made of a non-conductive material to secondarily limit the mandrel and the shell, and the corrugated pipe-shaped space is used for being filled with an insulating material.

In some embodiments, two first glue injection holes may be formed in the outer wall of the shell, and two second glue injection holes may be formed in the outer wall of the mandrel; the two first glue injection holes may be formed placed axially along the shell at intervals, and the two second glue injection holes may be formed axially along the mandrel at intervals; the two second glue injection holes which do not penetrate through the mandrel body may be positioned between the two first glue injection holes which penetrate through the shell body.

In some embodiments, axial extension lines of the two first glue injection holes may intersect on the inner side of the shell, and axial extension lines of the two second glue injection holes may intersect on the inner side of the mandrel; and when the mandrel and the shell are in an assembled state, the two first glue injection holes and the two second glue injection holes may be co-axially arranged respectively.

In some embodiments, threads may be arranged on the inner wall of the first glue injection hole and the inner walls of the second glue injection hole respectively.

In some embodiments, the groove may be a wedge-shaped groove, and the bottom surface of the wedge-shaped groove may be of a substantially trapezoidal structure.

In some embodiments, the second insulation limiting structure may be provided with a butt end, an arc-shaped groove may be formed in the butt ends, and the arc-shaped grooves of the second insulation limiting structures may be positioned on the same circular ring when the mandrel and the shell may be in an assembled state.

In some embodiments, a glue melting hole may be formed in the middle of the second insulation limiting structure.

In some embodiments, the second insulation limiting structure may be further provided with a first diversion trench and second diversion trenches, the first diversion trench may be arranged in the middle along the length directions of the second insulation limiting structures, and the second diversion trenches may be perpendicular to the first diversion trench and communicate with the first diversion trench, and the second diversion trenches may be uniformly distributed on two sides of the first diversion trench.

On the second aspect, the present disclosure provides an assembly method of an electromagnetic clearance joint. The method is achieved based on the electromagnetic clearance in the fourth technical scheme, and specifically comprises the following steps: step S100, aligning ridge structures of the mandrel with shell grooves, and aligning grooves of the mandrel with ridge structures of the shell;

step S200, inserting the mandrel into the shell, and rotating any one of the mandrel or the shell to a set angle, so that the acting grooves of the mandrel are matched with the shell acting grooves to form positioning threaded holes, the grooves of the mandrel are aligned with the grooves of the shell to form assembly spaces, and the ridge structures of the mandrel are matched with the ridge structures of the shell to form a corrugated pipe-shaped space;

step S300, respectively screwing the first insulation limiting structures into the positioning threaded holes so as to preliminarily limit the mandrel and the shell;

step S400, respectively inserting the second insulation limiting structures into the assembly spaces to secondarily limit the mandrel and the shell and prevent the mandrel and the shell from rotating;

step S500, connecting any one of the two first glue injection holes with a vacuum device, so that the vacuum device is communicated with the corrugated pipe-shaped space through the first glue injection holes, and evacuating air in the corrugated pipe-shaped space;

step S600, communicating an injection device with the corrugated pipe-shaped spaces through the other first glue injection hole, and injecting an insulating fluid into the corrugated pipe-shaped space until the corrugated pipe-shaped space is uniformly filled with all of the insulating fluid; and step S700, after the vacuum device and the injection device are detached, screwing threaded fasteners into the two first glue injection holes respectively for sealing.

In some embodiments, the insulating fluid may be epoxy resin or thermoplastic resin.

The present disclosure has the following beneficial effects:

The electromagnetic clearance joint overcomes the following defects through simple assembly steps that the assembly of an existing electromagnetic clearance joint is difficult and time and labor-consuming. Meanwhile, the torsional strength, impact resistance and high insulation performance of the clearance joint are improved by means of auxiliary assembly of threaded fasteners and insulation limiting structures, and the high compressive strength is enhanced while insulation is guaranteed by injecting flowable resin into the corrugated pipe-shaped spaces for curing, so that the service life is prolonged. Furthermore, according to a special method for assembling the electromagnetic clearance joint, the electrical property can be improved, effective operation can be achieved in a drilling site, and the construction efficiency is improved.

BRIEF DESCRIPTION OF THE DRAWINGS

Other features, objects and advantages of the present disclosure will become more apparent by reading the detailed description of non-restrictive embodiments, which is made with reference to the accompanying drawings.

Figure 1:
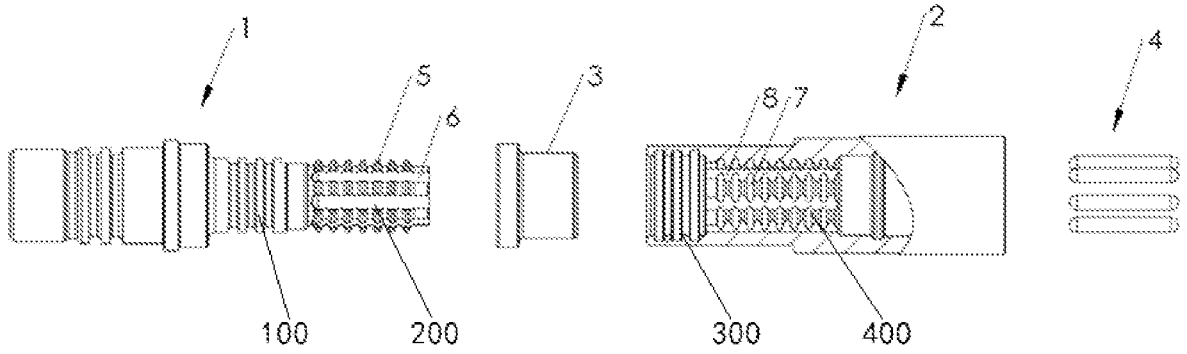
FIG. 1 is a exploded schematic diagram of an overall structure of an electromagnetic clearance joint according to the first embodiment of the present disclosure.
Figure 2:
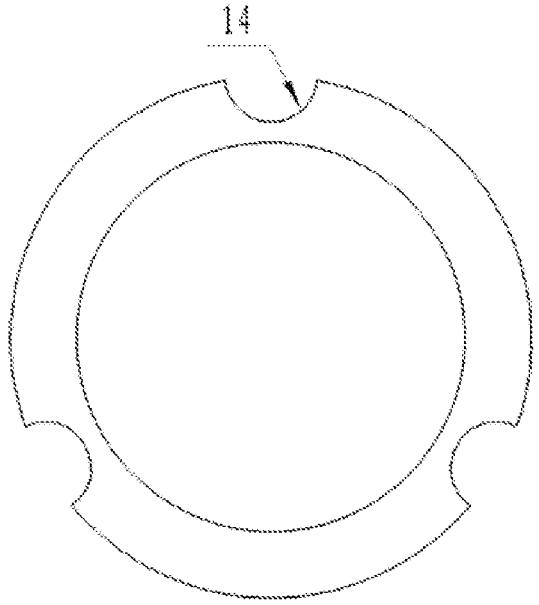
FIG. 2 is a schematic diagram of mandrel acting grooves of a according to the embodiment of the present disclosure.
Figure 3:
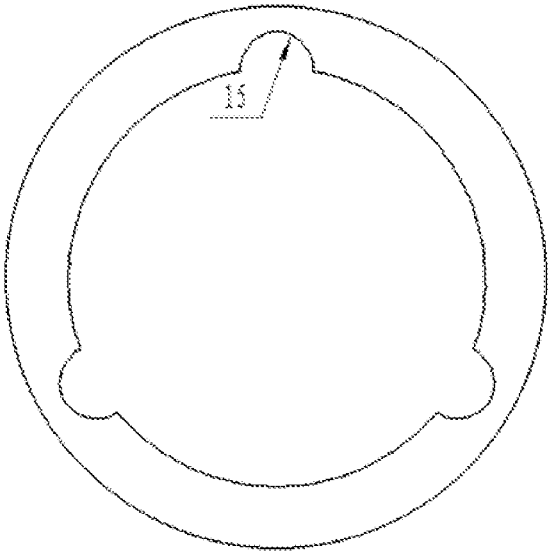
FIG. 3 is a structural schematic diagram of shell acting grooves of according to the embodiment of the present disclosure.
Figure 4:
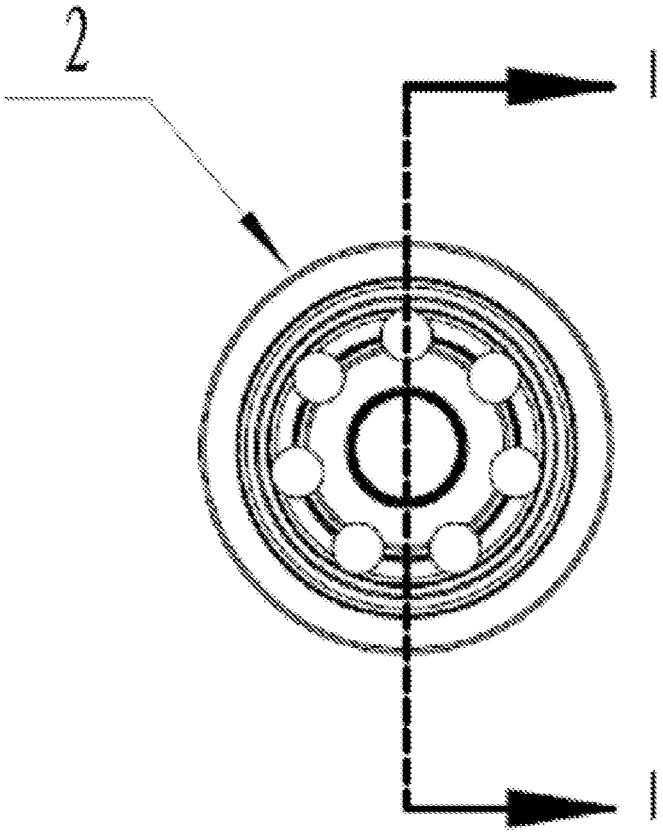
FIG. 4 is a schematic diagram of a cross section of the electromagnetic clearance joint according to the embodiment of the present disclosure.
Figure 5:
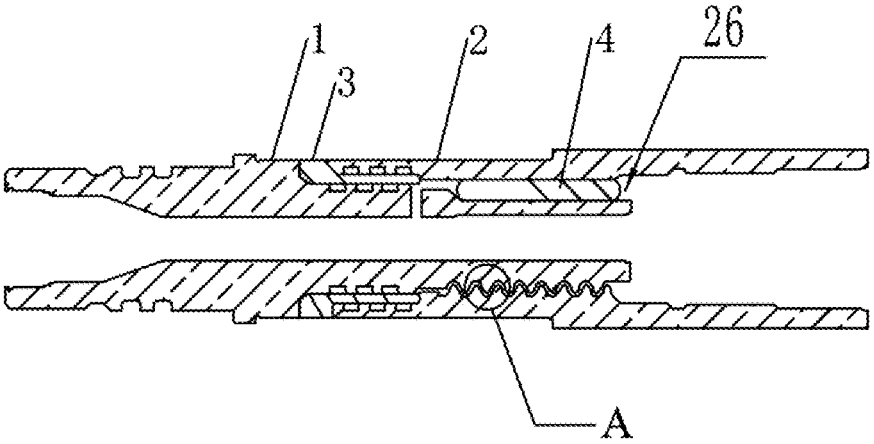
FIG. 5 is a cross-sectional view taken along a line I-I in FIG. 4.

Reference numerals in drawings: 1 mandrel; 2 shell; 3 sealing sleeve; 4 second insulation limiting structure; 41 glue melting hole; 42 first diversion trench; 43 second diversion trench; 5 mandrel ridge structure; 6 mandrel groove; 7 shell ridge structure; 8 shell groove; 10 corrugated pipe-shaped space; 11 flank; 12 root; 13 crest; 14 mandrel acting groove; 15 shell acting groove; 16 first glue injection hole; 17 second glue injection hole; 20 elastic sleeve; 21 ceramic sleeve; 22 sealing pressing ring; 23 sealing pressing ring; 24 positioning threaded hole; 25 first insulation limiting structure; and 26 assembly space.

DETAILED DESCRIPTION OF THE EMBODIMENTS

In order to make embodiments, technical schemes and advantages of the present disclosure more apparent, the technical schemes of the present disclosure will be clearly and fully described below in conjunction with the accompanying drawings, and apparently, the described embodiments are some, but not all, embodiments of the present disclosure. It should be understood by those skilled in the art that these embodiments are merely used to explain the technical principles of the present disclosure and are not intended to limit the scope of protection of the present disclosure.

An electromagnetic clearance joint disclosed by the present disclosure includes a mandrel and a shell. An inner diameter of the shell is larger than an outer diameter of the mandrel, the mandrel includes a first structure part and a second structure part which are sequentially connected, and the shell includes a third structure part and a fourth structure part which are sequentially connected.

A plurality of acting grooves are formed in the first structure part, and a thread 27 is provided on an inner surface of each acting groove. The acting grooves are uniformly and circumferentially distributed around the first structure part.

An outer diameter of the first structure part is gradually reduced in a direction close to the second structure part, an outer surface of the second structure part is provided with a plurality of annular ridges sequentially distributed axially along the mandrel, and ridge structures are formed by the annular ridges; a plurality of grooves extending axially along the ridge structures are formed in outer surfaces of the ridge structures, and the grooves are uniformly and circumferentially arrayed around the ridge structure.

The mandrel is matched with the shell, and in an assembled state, the first structure part is in clearance fit with the third structure part, and the second structure part is in clearance fit with the fourth structure part.

During assembling, the grooves of the mandrel are aligned with a ridge structures of the shell so that the mandrel can be inserted into the shell, the mandrel is screwed such that the acting grooves of the mandrel are matched with the acting grooves of the shell to form positioning threaded holes 24, the grooves of the mandrel are aligned with grooves of the shell to form assembly spaces 26, and the ridge structures of the mandrel are matched with the shell ridge structures to form corrugated pipe-shaped spaces.

The positioning threaded holes 24 are configured for receiving first insulation limiting structures 25 made of a non-conductive material into to primarily limit the mandrel and the shell, the assembly spaces 26 are configured for receiving second insulation limiting structures made of a non-conductive material to secondarily limit the mandrel and the shell, and the corrugated pipe-shaped spaces are configured for being filled with an insulating material.

In order to more clearly illustrate the electromagnetic clearance joint of the present disclosure, a preferred embodiment of the present disclosure is described in detail with reference to the accompanying drawings.

Embodiment I

As a preferred embodiment of the present disclosure, as shown in FIG. 1, the electromagnetic clearance joint disclosed by the present disclosure includes a mandrel 1 and a shell 2. An inner diameter of the shell 2 is larger than an outer diameter of the mandrel 1, and the shell 2 is matched with the mandrel 1 in structure. The mandrel 1 includes a first structure part 100 and a second structure part 200 which are connected to each other, and the shell 2 includes a third structure part 300 and a fourth structure part 400 which are connected to each other. In an assembled state, the first structure part 100 is in clearance fit with the third structure part 300, and the second structure part 200 is in clearance fit with the fourth structure part 400.

The first structure part 100 is provided with acting grooves, namely mandrel acting grooves 14 as shown in the figure. It is understood that the third structure part 300 of the shell is also correspondingly provided with shell acting grooves 15. The number of the mandrel acting grooves 14 and the number of the shell acting grooves 15 are the same, and threads 27 are arranged on inner surfaces of the mandrel acting grooves 14 and the shell acting grooves 15 respectively. A plurality of mandrel acting grooves 14 are uniformly and circumferentially distributed around the first structure part 100, a plurality of shell acting grooves 15 are uniformly and circumferentially distributed around the third structure part 300, the mandrel acting grooves 14 are sunken towards a center of the mandrel, the shell acting grooves 15 are sunken towards an outer edge of the shell, and the mandrel acting grooves 14 and the shell acting grooves 15 can form the positioning threaded holes in the assembled state. In the preferred embodiment of the present disclosure, there are three positioning threaded holes to form a triangular structure so that primary positioning is more stable.

An outer diameter of the first structure part 100 is gradually reduced in a direction close to the second structure part 200, an outer surface of the second structure part 200 is provided with a plurality of annular ridges sequentially distributed axially along the mandrel, and mandrel ridge structures 5 are formed by the annular ridges. A plurality of mandrel grooves 6 extending axially along the ridge structures are formed in outer surfaces of the ridge structures, and the mandrel grooves 6 are uniformly and circumferentially arrayed around the mandrel ridge structure 5.

The mandrel 1 is matched with the shell 2, and the inner diameter of the shell 2 is larger than the outer diameter of the mandrel 1, so that when the mandrel 1 is inserted into the shell 2, a clearance can be reserved between the mandrel 1 and the shell 2. Similarly, an inner surface of the shell 2 is also provided with a plurality of annular ridges sequentially arranged axially along the shell 2, and shell ridge structures 7 are formed by the annular ridges. A plurality of shell grooves 8 extending axially along the ridge structures 7 are formed in inner surfaces of the ridge structures 7, and the shell grooves 8 are uniformly and circumferentially arrayed around the shell ridge structure 7.

During assembling, the assembly of the mandrel 1 and the shell 2 can be completed by rotating any one of the mandrel 1 and the shell 2.

Specifically, during assembling, firstly, the mandrel ridge structures 5 on the mandrel 1 are aligned with the shell grooves 8 on the inner surface of the shell 2, similarly, the mandrel grooves 6 on the mandrel 1 are aligned with the shell ridge structures 7 on the inner surface of the shell 2, so that the mandrel 1 can be inserted into the shell 2. Through geometrical shapes of the grooves and ridge structures, sufficient clearance is provided for the mandrel 1, so that the mandrel 1 slides without abutting against the shell 2.

Furthermore, the mandrel 1 or the shell 2 is screwed so that the mandrel acting grooves 14 of the mandrel 1 are matched with the acting shell grooves 15 to form the positioning threaded holes which are configured for receiving first insulation limiting structures made of a non-conductive material to primarily limit the mandrel and the shell; where, the mandrel grooves 6 of the mandrel 1 are aligned with the shell grooves 8 of the shell to form the assembly spaces, and while the mandrel grooves 6 are aligned with the shell grooves 8 of the shell 2 to form the assembly spaces, the mandrel ridge structures 5 of the mandrel 1 are matched with the shell ridge structures 7 of the shell 2 to form the corrugated pipe-shaped spaces. The assembly spaces are configured for receiving second insulation limiting structures made of a non-conductive material to further limit the mandrel and the shell. The corrugated pipe-shaped spaces are configured for being filled with an insulating material. In some preferred embodiments, the columnar structure resulting from the alignment of the mandrel grooves 6 with the shell grooves 8 is particularly suitable for efficient manufacturing, which can be produced by drilling rather than other more expensive and laborious structures.

In some preferred embodiments, the mandrel 1 and the shell 2 can be connected together by means of axis concentricity and the rotational alignment, so that the interference between the mandrel ridge structures 5 of the mandrel 1 and the shell ridge structures 7 of the shell is avoided. When the mandrel 1 is fully inserted into the shell 2, the mandrel 1 can be rotated by a predetermined angle, so that the mandrel ridge structures 5 of the mandrel 1 and the shell ridge structure 7 of the shell 2 are aligned and overlapped. In the preferred embodiment of the present disclosure, the predetermined rotation angle theta is in the range of 26° to 30° (clockwise or counterclockwise), and the rotation angle depends on the number of the mandrel grooves 6 spaced around the circumference of the mandrel ridge structures 5. In the preferred embodiment of the present disclosure, the number of the mandrel grooves 6 and the number of the shell grooves 8 are seven, and the number of the mandrel grooves 6 and the number of the shell grooves 8 can also be flexibly set by those skilled in the art according to actual situations as long as the mandrel 1 and the shell 2 are provided with the same number of the grooves. Furthermore, in the circumferential direction of each annular ridge, the proportion of the grooves and the proportion of the ridge structures are the same, that is, the proportion of the widths of the grooves in the circumferential direction of the annular ridge is the same as that of the ridge structures in the circumferential direction of the annular ridge. More preferably, the width of the grooves is equal to or slightly greater than the width of the ridge structures reserved between the grooves for convenience in assembly.

After the mandrel ridge structures 5 of the mandrel 1 and the shell ridge structures 7 of the shell 2 are in place, the corrugated pipe-shaped spaces are formed between the mandrel ridge structures 5 and the shell ridge structures 7 in the fully inserted overlapping positions.

Figure 6:
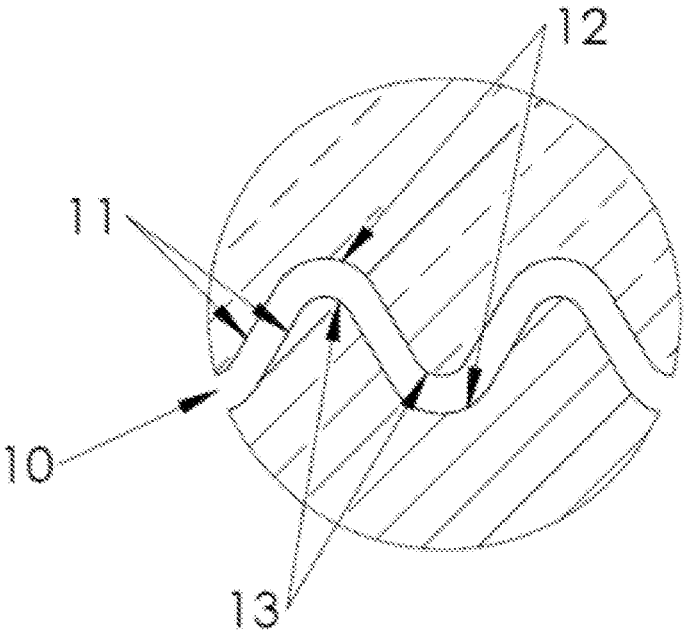
FIG. 6 is an enlarged drawing of a section A in FIG. 5.
Figure 7:
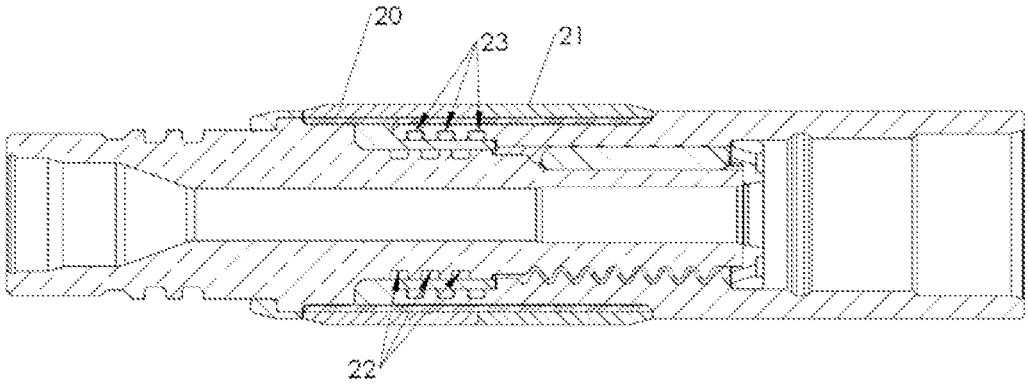
FIG. 7 is a structural schematic diagram of a ceramic sleeve assembled according to the embodiment of the present disclosure.
Figure 8:
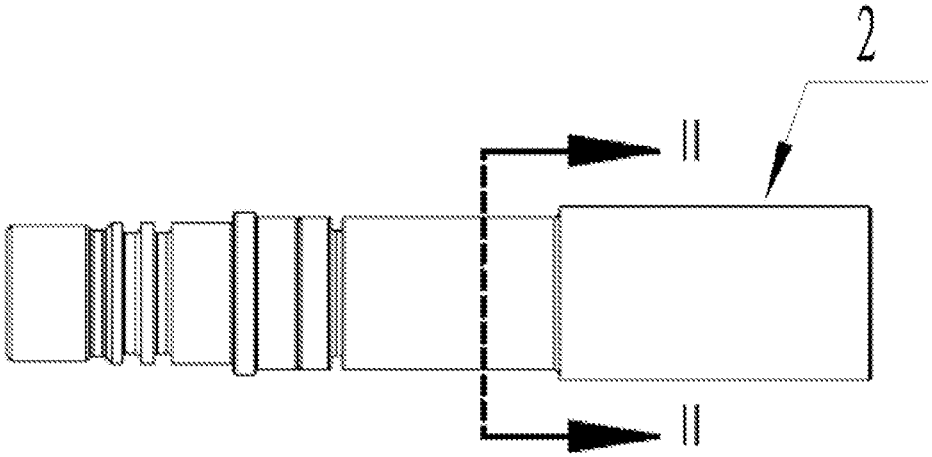
FIG. 8 is a schematic diagram of an overall structure of the electromagnetic clearance joint according to the embodiment of the present disclosure.
Figure 9:
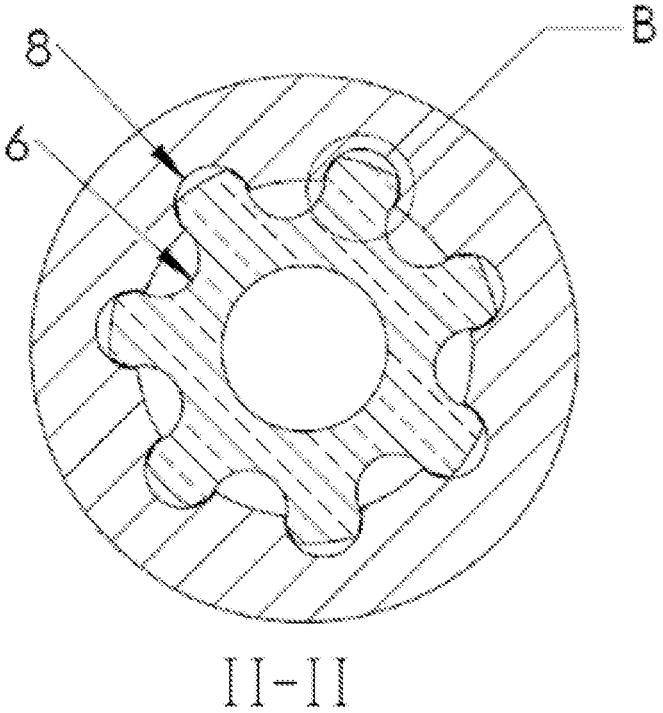
FIG. 9 is a section view taken along a line II-II in FIG. 8.
Figure 10:
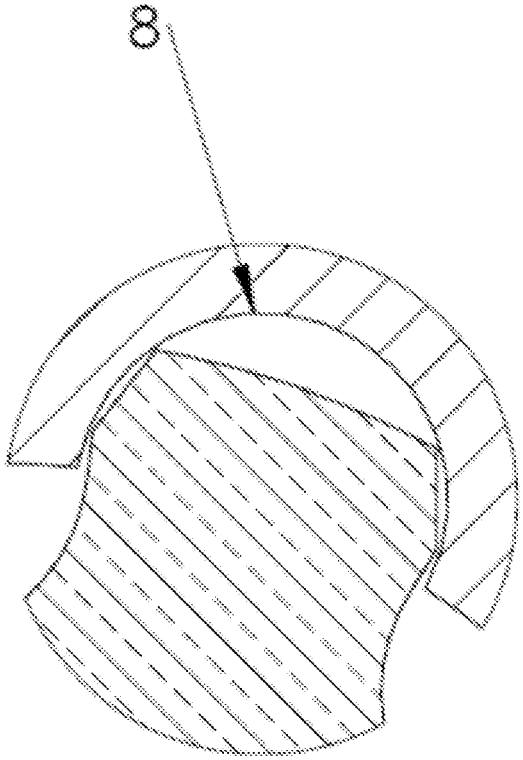
FIG. 10 is an enlarged schematic diagram of a section B in FIG. 9.

Specifically, referring to FIG. 6, each ridge structure includes flanks 11, crests 13 and roots 12, and therefore, the corrugated pipe-shaped spaces 10 are formed between the mandrel ridge structures 5 and the shell ridge structures 7. For example, a clearance of 0.040-0.050 mm can provide sufficient clearance for tiny machining defects and still provide good overlap between adjacent ridges.

Furthermore, during fixing, the first insulation limiting structures made of a non-conductive material are screwed into the positioning threaded holes, so that the mandrel 1 and the shell 2 are preliminarily positioned by the first insulation limiting structures; then, the second insulation limiting structures 4 made of a non-conductive material are inserted into the assembly spaces to secondarily limit the mandrel and the shell, and the mandrel 1 and the shell 2 can be prevented from rotating relative to each other around the axes of the mandrel 1 and the shell 2. The first insulation limiting structures and the second insulation limiting structures are preferably made of the non-conductive material with high shear strength, such as glass-filled PEEK (polyetheretherketone). The second insulation limiting structures made of the material can improve the strength of torque transmission from the mandrel 1 to the shell 2. Preferably, in the embodiment, bottom surfaces of the grooves each are a cylindrical surface and the assembly spaces each are a columnar space, the cylindrical geometrical shape of the columnar space is beneficial for manufacturability as the columnar space enables simple cylindrical pins to be used as the second insulation limiting structures 4.

Then, the corrugated pipe-shaped spaces 10 between the mandrel ridge structures 5 and the shell ridge structures 7 are filled. Optionally, a first prefabricated hole and a second prefabricated hole are further formed in the electromagnetic clearance joint. The first prefabricated hole and the second prefabricated hole are formed in the length direction of the electromagnetic clearance joint at intervals. When the mandrel 1 and the shell 2 are in the assembled state, one end of the first prefabricated hole and one end of the second prefabricated hole communicate with the outside, and the other end of the first prefabricated hole and the other end of the second prefabricated hole communicate with the corrugated pipe-shaped spaces 10. The first prefabricated hole is configured for being connected with a vacuum pump, and the second prefabricated hole is configured for being connected with an injection gun. The corrugated pipe-shaped space 10 can be filled with non-conductive thermosetting resin during assembling, such as epoxy resin obtained by mixing two components, or injectable thermoplastic resin. In order to best achieve uniform filling, it may be beneficial to firstly evacuate the air in the clearance by the vacuum pump. For example, the epoxy resin obtained by mixing two components can be injected into corrugated pipe-shaped spaces 10 at a relatively low pressure. When the selected epoxy resin is lower in viscosity after mixing, the pressure of 40 to 60 psi is usually sufficient to cause the selected epoxy resin to flow along the corrugated pipe-shaped spaces 10. In addition, the filling material of the corrugated pipe-shaped spaces has high structural property, such as high compressive strength at the intended operating temperature of the clearance joint. For example, depending on the formulation of the thermosetting resin, a time/temperature curing scheme may be required to achieve optimal strength. Through the arrangement of the prefabricated holes, on one hand, detachable connectors can be inserted for temporarily limiting the axial movement of the mandrel 1 relative to the shell 2, and on the other hand, the prefabricated holes can also be configured for as injection and vacuum ports.

When the filling material of the corrugated pipe-shaped spaces is hardened, a temporary device connected with the first prefabricated hole and the second prefabricated hole is removed, an external insulation sealing sleeve 3 is covered on the clearance joint, and the specific position is as shown in FIG. 1.

Preferably, the seal at the joint of the mandrel 1 and the shell 2 may be achieved by the combination of a set of 0-shaped sealing pressing rings 22 and sealing pressing rings 23, and the set of 0-shaped sealing pressing rings act on a smooth, non-porous sealing sleeve surface to resist the invading of a downhole high-pressure drilling fluid. Alternatively, other similar sealing known in the industry is used.

In order to further improve sealing performance and generate a longer non-conductive outer surface on the surface of the clearance joint, an elastomer sleeve 20 can be molded onto the finished joint. In order to protect the elastic sleeve 20 from being corroded due to the fact that high-speed mud flows through the joint, a non-conductive ceramic sleeve 21 can be installed on the elastic sleeve 20. The ceramic sleeve can be segmented to improve the manufacturability and can also relieve some bending stresses when components of MWD (Measure While Drilling) is operated in a curved wellbore.

Embodiment II

Figure 11:
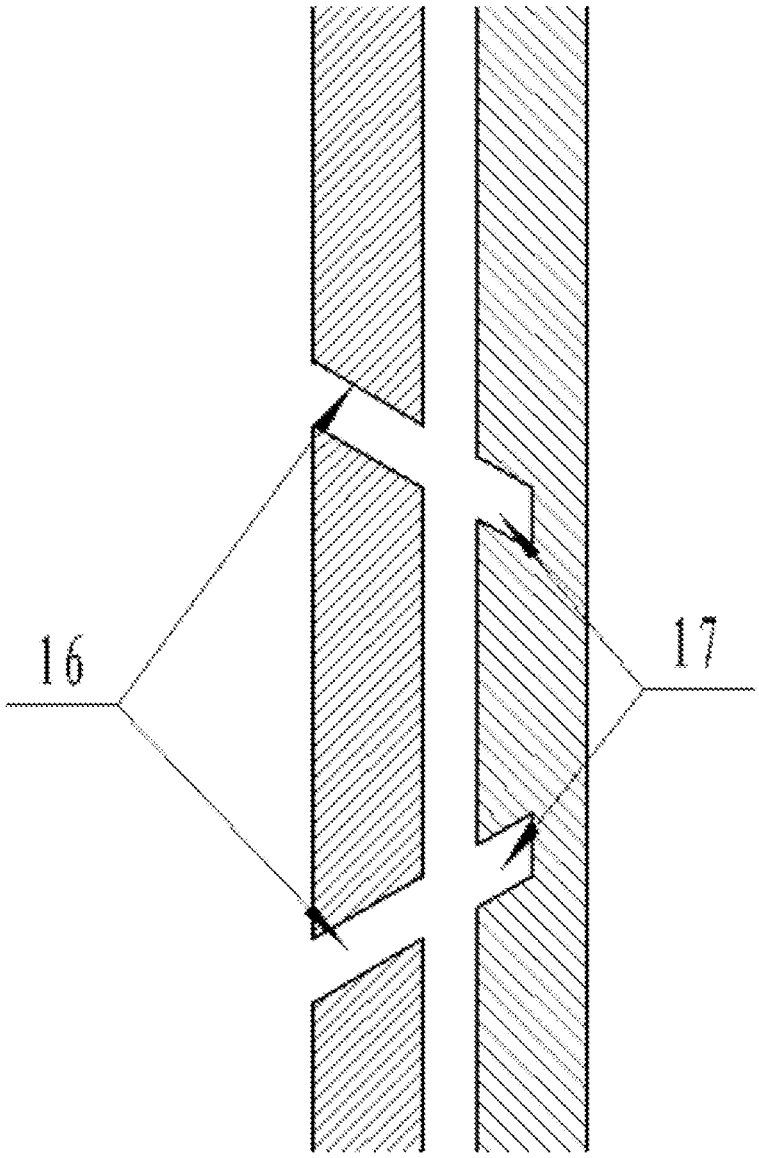
FIG. 11 is a schematic diagram structures of glue injection holes according to a second embodiment of the present disclosure.

Referring to FIG. 11, compared with the first embodiment, the difference lies in that two first glue injection holes 16 are formed in an outer wall of the shell 2, and two second glue injection holes 17 are formed in an outer wall of the mandrel 1. Preferably, the first glue injection holes 16 correspond to the mandrel ridge structures 5, and the second glue injection holes 17 correspond to the shell ridge structures 7. The two first glue injection holes are formed in the length direction of the shell 2 at intervals, and the two second glue injection holes 17 are formed in the length direction of the mandrel 1 at intervals. The two second glue injection holes 17 are positioned between the two first glue injection holes 16. The first glue injection holes 16 penetrate through the shell 2, and the second glue injection holes 17 do not penetrate through the mandrel 1. Furthermore, axial extension lines of the two first glue injection holes 16 intersect at the inner side of the shell 2, and axial extension lines of the two second glue injection holes 17 intersect at the inner side of the mandrel 1. When the mandrel 1 and the shell 2 are in the assembled state, the two first glue injection holes 17 and the two second glue injection holes 18 are co-axially arranged respectively. Preferably, threads are arranged on inner walls of the first glue injection holes and inner walls of the second glue injection holes respectively. Due to the fact that the first glue injection holes and the second glue injection holes are obliquely formed, the first glue injection holes and the second glue injection holes can also serve as positioning structures to position the electromagnetic clearance joint. Specifically, two threaded fasteners can be inserted into the two first glue injection holes respectively and screwed until the threaded fasteners are engaged with the second glue injection holes, so that radial movement and rotation between the mandrel and the shell are prevented, and the mandrel and the shell can be fixed as well.

Aiming at this embodiment, the present disclosure provides a preferred embodiment of a method for assembling an electromagnetic clearance joint, specifically comprising the following steps:

step S100, aligning the mandrel ridge structure 5 with the shell grooves 8 to be matched with each other, and aligning the mandrel grooves 6 with the shell ridge structure 7;

step S200, inserting the mandrel 1 into the shell 2, and rotating either the mandrel 1 or the shell 2 by a predetermined angle theta, preferably, which is in the range of 26° to 30°, so that mandrel acting grooves 14 are matched with the shell acting grooves 15 to form the positioning threaded holes, the mandrel grooves 6 are aligned with the shell grooves 8 to form the assembly spaces, and the mandrel ridge structure 5 are matched with the shell ridge structure 7 to form the corrugated pipe-shaped spaces;

step S300, screwing the first insulation limiting structures into the positioning threaded holes so as to preliminarily limit the mandrel 1 and the shell 2;

step S400, inserting the second insulation limiting structures 4 into the assembly spaces to further limit the mandrel 1 and the shell 2 and prevent the mandrel 1 and the shell 2 from rotating;

step S500, connecting one of the two first glue injection holes 6 with a vacuum device, such that the vacuum device is communicated with the corrugated pipe-shaped spaces 10 through the first glue injection holes 16, and evacuating air in the corrugated pipe-shaped spaces;

step S600, communicating an injection device with the corrugated pipe-shaped spaces 10 through the other first glue injection hole of the two first glue injection holes 16, and injecting an insulating fluid into the corrugated pipe-shaped space 10 until the corrugated pipe-shaped spaces 10 are uniformly filled with all of the insulating fluid; and step S700, screwing the two threaded fasteners into the two first glue injection holes 16 respectively after the vacuum device and the injection device are detached, until the threaded fasteners abut against the second glue injection holes 17, so that the glue injection holes are sealed. Preferably, the insulating fluid in the installation scheme is epoxy resin or thermoplastic resin.

Embodiment III

Figure 12:
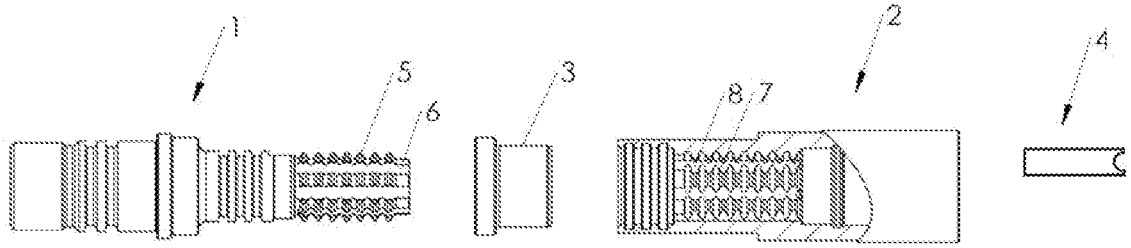
FIG. 12 is a exploded schematic diagram of an overall structure of an electromagnetic clearance joint according to a third embodiment of the present disclosure.

Referring to FIG. 12, compared with the second embodiment, the difference lies in that both the mandrel grooves and the shell grooves are a wedge-shaped groove, a bottom surface of the wedge-shaped groove is of a substantially trapezoidal structure, and the assembly spaces are wedge-shaped spaces. Specifically, when the grooves are wedge-shaped grooves, the second insulation limiting structures are wedge-shaped structures matched with the wedge-shaped grooves, and a thickness of a front end of each wedge-shaped structure is smaller than that of a rear end of the wedge-shaped structure. Preferably, the second insulation limiting structures are provided with butt ends, arc-shaped grooves are formed in the butt ends, and the arc-shaped grooves of the second insulation limiting structures 4 are located on the same circle when the mandrel 1 and the shell 2 are in the assembled state. Furthermore, the structure can enable the insulating fluid in the corrugated pipe-shaped spaces to flow into the wedge-shaped grooves, so that the assembling strength of the mandrel 1 and the shell 2 is further improved.

Figure 13:
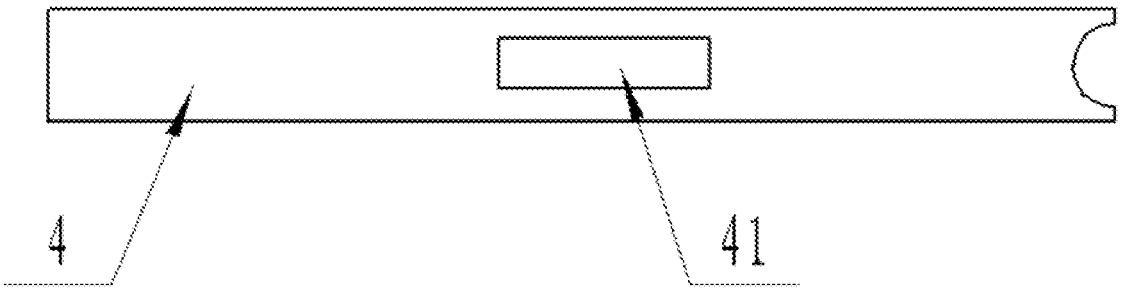
FIG. 13 is a first schematic diagram of a second insulation limiting structure according to an embodiment of the present disclosure.

In some preferred embodiments, referring to FIG. 13, a glue melting hole 41 is formed in a middle of each of the second insulation limiting structures 4. The glue melting hole 41 is located between the two second glue injection holes and the two first glue injection holes in the assembling state and configured for accommodating the insulating fluid, finally the threaded fasteners can penetrate through the glue melting hole 41, and the shell 1, the second insulation limiting structures 4 and the mandrel 2 are fixed. Due to the fact that the glue melting hole 41 is arranged in an inward concave manner, the assembling process of the second insulation limiting structures 4 is not affected, and the bending resistance and the fixing capability of the second insulation limiting structures 4 can be enhanced by adopting the structure.

Figure 14:
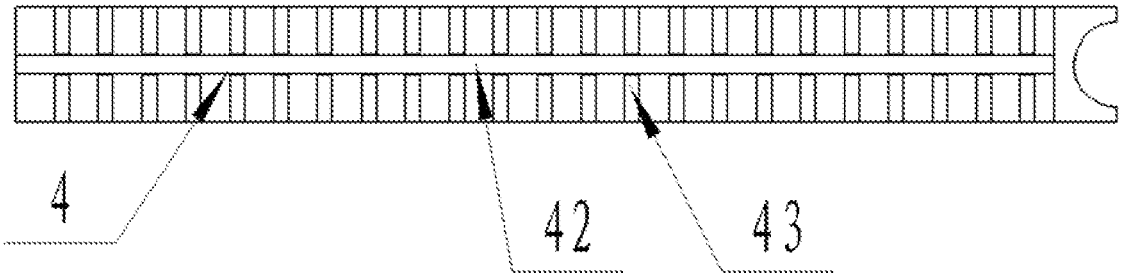
FIG. 14 is a second schematic diagram of a second insulation limiting structure according to an embodiment of the present disclosure.
Figure 15:
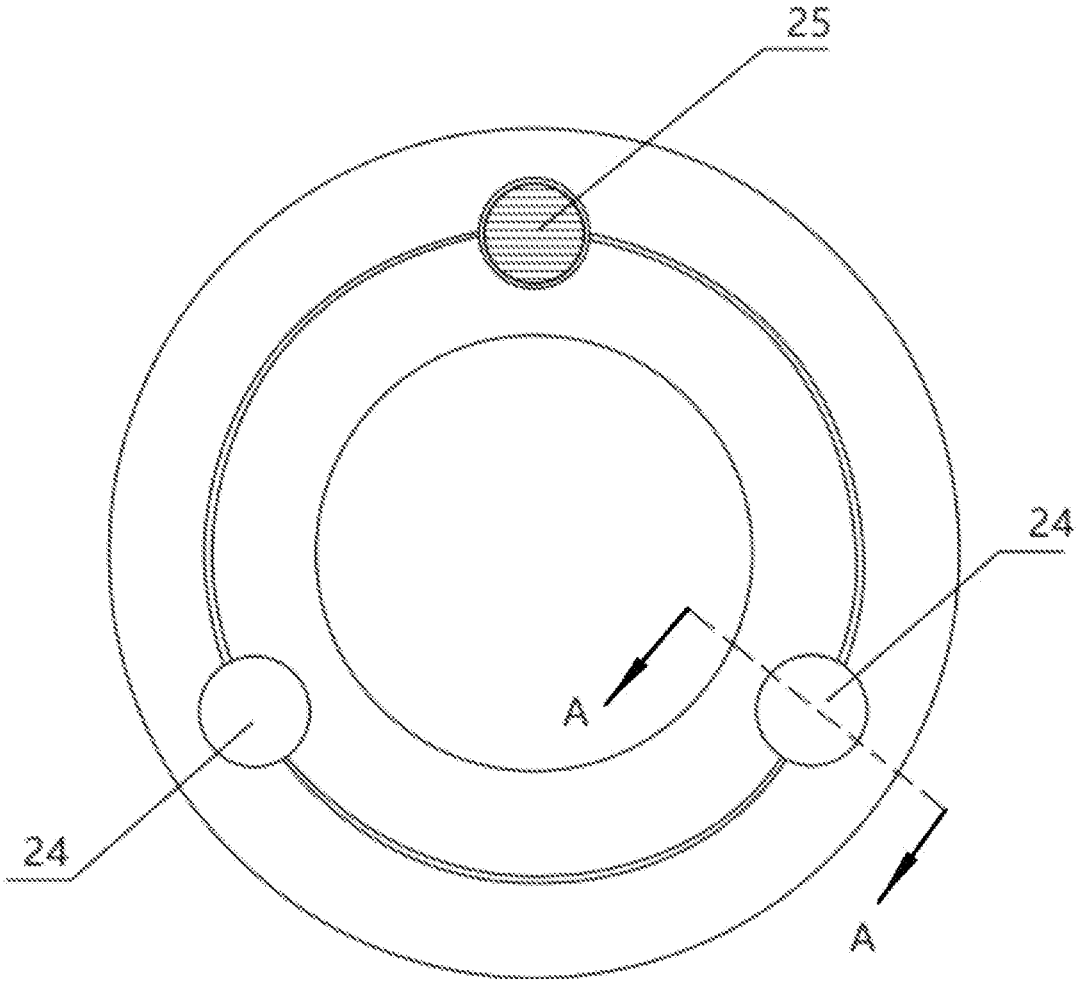
FIG. 15 is a schematic drawing showing the mandrel acting grooves of FIG. 2 and the shell acting grooves of FIG. 3 in an assembly state, wherein positioning threaded holes and first insulating structures screwed into the positioning threaded holes are schematically shown.
Figure 16:
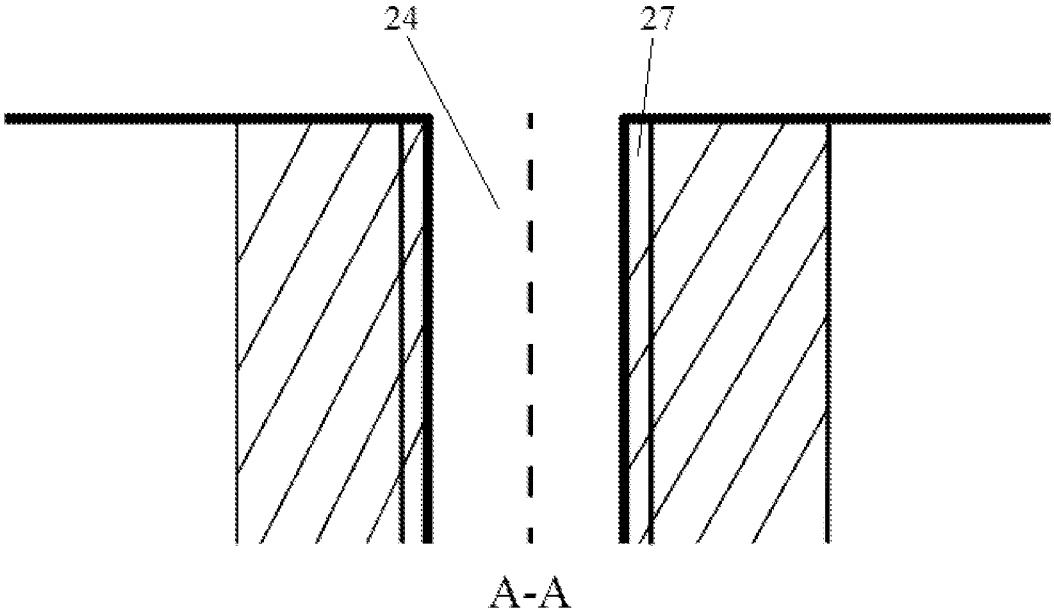
FIG. 16 is a cross-sectional view of a shell acting groove and a mandrel acting groove taken along a line A-A in FIG. 15.

Furthermore, as shown in FIG. 14, in other preferred embodiments, the second insulation limiting structures 4 each are further provided with a first diversion trench 42 and second diversion trenches 43, the first diversion trench 42 is arranged in a middle along the length direction of a respective second insulation limiting structure 4, and the second diversion trenches 43 are perpendicular to the first diversion trench 42 and communicate with the first diversion trench 42, and the second diversion trenches 34 are uniformly distributed on two sides of the first diversion trench 41. The diversion trenches are configured for discharging redundant insulating fluid from the assembly spaces, the redundant insulating fluid spilled from the corrugated pipe-shaped spaces can flow into the first diversion trench 42 through the second diversion trenches 43, and the first diversion trench 42 penetrates through the second insulation limiting structures 4, so that the insulating fluid in the first diversion trench 42 can be guided out of the second insulation limiting structures 4, and the problem that the quality of assembled products is unqualified due to overlarge stress is avoided.

It can be understood that the arrangement enables communication between the assembly spaces and the corrugated pipe-shaped spaces even in the assembled state, so that the insulating material can flow into the assembly spaces from the corrugated pipe-shaped spaces.

In other preferred embodiments, S-shaped grooves are formed in surfaces on the side, close to the shell 2, of the second insulation limiting structures 4 respectively. The S-shaped grooves each transversely penetrate through the two sides of a respective second insulation limiting structure 4, are sequentially formed in the length direction of the second insulation limiting structures 4 at intervals and are configured for accommodating the insulating fluid. Because the groove structures are arranged in an inward concave manner, the assembling process of the second insulation limiting structures 4 is not affected, and the bending resistance and the fixing capability of the second insulation limiting structures 4 can be enhanced by adopting the structure. Furthermore, S-shaped grooves are also formed in the wedge-shaped grooves of the shell 2, and the direction of the grooves is away from the mandrel to be arranged in a sunken mode. In the assembling state, the S-shaped grooves of the shell 2 can be matched with the S-shaped grooves of the second insulation limiting structures 4 to form S-shaped tubular spaces. Due to the fact that the insulating material in the corrugated pipe-shaped spaces can flow into the wedge-shaped spaces, by adopting the arrangement, the insulating material can form S-shaped columnar structures after being cooled and solidified in the S-shaped tubular spaces. The arrangement can further prevent the second insulation limiting structures 4 from axially moving, and the cooled and solidified insulating material can prevent the second insulation limiting structures 4 from radially and axially moving, so that the bending resistance and the stability of the second insulation limiting structures 4 are ensured. The embodiment is not illustrated by the accompanying drawings, and it can be understood that the embodiment has been described by text, and the technical schemes in the embodiment can be recognized by those skilled in the art by text and are not illustrated by the accompanying drawings.

The technical scheme in the embodiment of the present disclosure at least has the following technical effects and advantages:

The electromagnetic clearance joint overcomes the defects that the assembly of an existing electromagnetic clearance joint is difficult and time and labor-consuming through simple assembly steps. Meanwhile, the torque strength resistance, impact resistance and high insulation performance of the clearance joint are improved by means of auxiliary assembly of threaded fasteners and insulation limiting structures, and the high compressive strength is enhanced while insulation is guaranteed by injecting flowable resin into the corrugated pipe-shaped space for curing, so that the service life is prolonged. Furthermore, according to a special method for assembling the electromagnetic clearance joint, the electrical property can be improved, effective operation can be achieved in a drilling site, and the construction efficiency is improved.

In the description of the present disclosure, it needs to be illustrated that the indicative direction or position relations of the terms such as "center", "upper", "lower", "left", "right", "vertical", "horizontal", "inside" and "outside" are direction or position relations illustrated based on the accompanying drawings, only for facilitating the description of the present disclosure and simplifying the description, but not for indicating or hinting that the indicated device or element must be in a specific direction and is constructed and operated in the specific direction, the terms cannot be understood as the restriction of the present disclosure. Moreover, the terms such as "first", "second" and "third" are only used for purpose of description but cannot be understood to indicate or hint relative importance.

Moreover, in the description of the present disclosure, it needs to be illustrated that, except as otherwise noted, the terms such as "install", "link" and "connect" should be generally understood, for example, the components can be fixedly connected, and also can be detachably connected or integrally connected; the components can be mechanically connected, and also can be electrically connected; the components can be directly connected and also can be indirectly connected through an intermediate, and two components can be communicated internally. For those skilled in the art, the specific meanings of the terms in the present disclosure can be understood according to specific conditions.

Moreover, the terms "comprise" or other variants are intended to cover a non-exclusive inclusion, so that a process, a method, an article, or a device that includes a list of elements not only includes those elements but also includes other elements that are not expressly listed, or further includes elements inherent to such a process, method, article or device.

Thus, the technical schemes of the present disclosure has been described in combination with the preferred embodiments illustrated in the accompanying drawings, but it is readily understood by those skilled in the art that the scope of protection of the present disclosure is obviously not limited to these specific embodiments. On the premise that the principle of the present disclosure is not deviated, those skilled in the art can make equivalent changes or replacements to related technical features, and the technical schemes after the changes or replacements will fall within the protection scope of the present disclosure.

What is claimed is:

1. An electromagnetic clearance joint, comprising a mandrel and a shell, wherein an inner diameter of the shell is larger than an outer diameter of the mandrel, the mandrel comprises a first structure part and a second structure part which are connected to each other, and the shell comprises a third structure part and a fourth structure part which are connected to each other;

a plurality of acting grooves are formed in the first structure part, and a thread is arranged on an inner surface of each of the plurality of acting grooves; the plurality of acting grooves are uniformly and circumferentially distributed around the first structure part;

an outer diameter of the first structure part is gradually reduced in a direction close to the second structure part, an outer surface of the second structure part is provided with a plurality of annular ridges sequentially distributed in a length direction of the mandrel, and ridge structures are formed by the plurality of annular ridges; a plurality of grooves extending in a length direction of the ridge structures are formed in outer surfaces of the ridge structures, and the plurality of grooves are uniformly and circumferentially arrayed around the ridge structures;

the mandrel is matched with the shell, and in an assembled state, the first structure part is in clearance fit with the third structure part, and the second structure part is in clearance fit with the fourth structure part;

during assembling, the plurality of grooves of the mandrel are aligned with a ridge structures of the shell so that the mandrel is capable of be inserted into the shell, the mandrel is screwed such that the acting grooves of the mandrel are matched with acting grooves of the shell to form positioning threaded holes, the plurality of grooves of the mandrel are aligned with grooves of the shell to form assembly spaces, and the ridge structures of the mandrel are matched with the ridge structure of the shell to form corrugated pipe-shaped spaces; and the positioning threaded holes are configured for receiving first insulation limiting structures made of a first non-conductive material, the assembly spaces are configured for receiving second insulation limiting structures made of a second non-conductive material, and the corrugated pipe-shaped spaces is configured for being filled with an insulating material;

wherein two first glue injection holes are formed in an outer wall of the shell, and two second glue injection holes are formed in an outer wall of the mandrel;

the two first glue injection holes are formed in a length direction of the shell at intervals, and the two second glue injection holes are formed in the length direction of the mandrel at intervals;

the two second glue injection holes are positioned between the two first glue injection holes; and the first glue injection holes penetrate through the shell, and the second glue injection holes do not penetrate through the mandrel.

2. The electromagnetic clearance joint according to claim 1, wherein axial extension lines of the two first glue injection holes intersect at an inner side of the shell, and axial extension lines of the two second glue injection holes intersect at an inner side of the mandrel; and when the mandrel and the shell are in the assembled state, the two first glue injection holes and the two second glue injection holes are coaxially arranged respectively.

3. The electromagnetic clearance joint according to claim 2, wherein threads are arranged on inner walls of the first glue injection holes and inner walls of the second glue injection holes respectively.

4. The electromagnetic clearance joint according to claim 1, wherein the grooves are wedge-shaped grooves having bottom surfaces in a substantially trapezoidal shape.

5. The electromagnetic clearance joint according to claim 4, wherein the second insulation limiting structures are provided with butt ends, arc-shaped grooves are formed in the butt ends, and the arc-shaped grooves of the second insulation limiting structures are located on a same circular ring when the mandrel and the shell are in the assembled state.

6. The electromagnetic clearance joint according to claim 5, wherein a glue melting hole is formed in a middle of each of the second insulation limiting structures.

7. The electromagnetic clearance joint according to claim 5, wherein the second insulation limiting structures each are further provided with a first diversion trench and second diversion trenches, the first diversion trench is arranged in a middle in a length direction of a respective second insulation limiting structure, and the second diversion trenches are perpendicular to the first diversion trench, are in communication with the first diversion trench, and are uniformly distributed on two sides of the first diversion trench.

8. A method for assembling an electromagnetic clearance joint, wherein, the electromagnetic clearance joint comprises a mandrel and a shell, wherein an inner diameter of the shell is larger than an outer diameter of the mandrel, the mandrel comprises a first structure part and a second structure part which are connected to each other, and the shell comprises a third structure part and a fourth structure part which are connected to each other;

a plurality of acting grooves are formed in the first structure part, and a thread is arranged on an inner surface of each of the plurality of acting grooves; the plurality of acting grooves are uniformly and circumferentially distributed around the first structure part;

an outer diameter of the first structure part is gradually reduced in a direction close to the second structure part, an outer surface of the second structure part is provided with a plurality of annular ridges sequentially distributed in a length direction of the mandrel, and ridge structures are formed by the plurality of annular ridges;

a plurality of grooves extending in a length direction of the ridge structures are formed in outer surfaces of the ridge structures, and the plurality of grooves are uniformly and circumferentially arrayed around the ridge structures;

the mandrel is matched with the shell, and in an assembled state, the first structure part is in clearance fit with the third structure part, and the second structure part is in clearance fit with the fourth structure part;

during assembling, the plurality of grooves of the mandrel are aligned with a ridge structures of the shell so that the mandrel is capable of be inserted into the shell, the mandrel is screwed such that the acting grooves of the mandrel are matched with acting grooves of the shell to form positioning threaded holes, the plurality of grooves of the mandrel are aligned with grooves of the shell to form assembly spaces, and the ridge structures of the mandrel are matched with the ridge structure of the shell to form corrugated pipe-shaped spaces; and the positioning threaded holes are configured for receiving first insulation limiting structures made of a first non-conductive material, the assembly spaces are configured for receiving second insulation limiting structures made of a second non-conductive material, and the corrugated pipe-shaped spaces is configured for being filled with an insulating material;

wherein threads are arranged on inner walls of two first glue injection holes and inner walls of two second glue injection holes respectively;

the method comprising the following steps of:

aligning the ridge structures of the mandrel with the grooves of the shell, and aligning the plurality of grooves of the mandrel with the ridge structures of the shell;

inserting the mandrel into the shell, and rotating either the mandrel or the shell by a predetermined angle theta, such that the acting grooves of the mandrel are matched with the acting grooves of the shell to form the positioning threaded holes, the plurality of grooves of the mandrel are aligned with the grooves of the shell to form the assembly spaces, and the ridge structures of the mandrel are matched with the ridge structures of the shell to form the corrugated pipe-shaped spaces;

screwing the first insulation limiting structures into the positioning threaded holes;

inserting the second insulation limiting structures into the assembly spaces to prevent the mandrel and the shell from rotating;

connecting one of the two first glue injection holes with a vacuum device, such that the vacuum device is communicated with the corrugated pipe-shaped spaces through the two first glue injection holes, and evacuating air in the corrugated pipe-shaped spaces;

communicating an injection device with the corrugated pipe-shaped spaces through an other first glue injection hole of the two first glue injection holes, and injecting an insulating fluid into the corrugated pipe-shaped spaces until the corrugated pipe-shaped spaces are uniformly filled with the insulating fluid; and screwing threaded fasteners into the two first glue injection holes respectively for sealing, after the vacuum device and the injection device are detached.

9. The method for assembling the electromagnetic clearance joint according to claim 8, wherein the insulating fluid is epoxy resin or thermoplastic resin.

* * * * *